US009850898B2

(12) United States Patent
Moetakef

(10) Patent No.: US 9,850,898 B2
(45) Date of Patent: Dec. 26, 2017

(54) GEROTOR PUMP FOR A VEHICLE

(71) Applicant: Ford Global Technologies, LLC, Dearborn, MI (US)

(72) Inventor: Mohammad Ali Moetakef, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 238 days.

(21) Appl. No.: 14/666,568

(22) Filed: Mar. 24, 2015

(65) Prior Publication Data

US 2016/0281711 A1 Sep. 29, 2016

(51) Int. Cl.

| | |
|---|---|
| ***F02B 55/14*** | (2006.01) |
| ***F04C 15/00*** | (2006.01) |
| ***F04C 2/10*** | (2006.01) |
| ***F04C 15/06*** | (2006.01) |
| ***F01M 1/02*** | (2006.01) |
| ***F04C 2/08*** | (2006.01) |

(52) U.S. Cl.

CPC ..... *F04C 15/0042* (2013.01); *F01M 1/02* (2013.01); *F04C 2/084* (2013.01); *F04C 2/102* (2013.01); *F04C 15/06* (2013.01); *F01M 2001/0238* (2013.01); *F04C 15/0061* (2013.01)

(58) Field of Classification Search

CPC ..... F01M 1/02; F01M 2001/0238; F04C 15/0042; F04C 2/102; F04C 15/0061; F04C 15/06

USPC ..... 418/72

See application file for complete search history.

(56) References Cited

U.S. PATENT DOCUMENTS 3,563,679 A * 1/1971 Richardson ..... F04C 2/102 418/72
3,592,572 A 7/1971 Schnell
4,235,217 A * 11/1980 Cox ..... F01C 1/103 123/232

(Continued)

FOREIGN PATENT DOCUMENTS

EP 0124299 A2 11/1984

OTHER PUBLICATIONS

Pauter.com, "The gerotor pump with a real difference!", 2014, 5 pages.

*Primary Examiner* — Mark Laurenzi
*Assistant Examiner* — Anthony Ayala Delgado
(74) *Attorney, Agent, or Firm* — Brooks Kushman P.C.; Greg Brown

(57) ABSTRACT

A gerotor pump is provided with a body defining a chamber with cylindrical wall sections and having a fluid inlet and a fluid outlet, and a cover. An internally toothed gear member is supported for rotation within the chamber about a first axis, and has a cylindrical outer wall defining a series of grooves. Each groove has an associated aperture extending through the gear member to an inner surface of the gear member, and is radially positioned between adjacent teeth of the internally toothed gear member. An externally toothed gear member is rotatably supported within the internally toothed gear member about a second axis spaced apart from the first axis, and is coupled for rotation with a drive shaft. The internally toothed gear member and externally toothed gear member cooperate to form a plurality of variable volume pumping chambers therebetween to pump fluid.

14 Claims, 5 Drawing Sheets

(56) References Cited

U.S. PATENT DOCUMENTS

| | | | |
|---|---|---|---|
| 5,733,111 | A | 3/1998 | Yu et al. |
| 6,113,360 | A | 9/2000 | Yu et al. |

* cited by examiner

GEROTOR PUMP FOR A VEHICLE

TECHNICAL FIELD

Various embodiments relate to an oil pump for a powertrain component such as an internal combustion engine or a transmission in a vehicle.

BACKGROUND

An oil pump is used to circulate oil or lubricant through powertrain components such as an engine or a transmission. The oil pump is often provided as a generated rotor or gerotor pump. Gerotor pumps have a positive displacement characteristic and tight clearances between various components of the pump that result in the formation of pressure ripples or fluctuations of the fluid within the pump and the attached oil galleries during operation of the pump. The pressure ripples of the fluid in the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a gerotor pump is provided with a body defining a chamber with cylindrical wall sections and having a fluid inlet and a fluid outlet. A cover is configured to mate with the body to enclose the chamber. An internally toothed gear member is supported for rotation within the chamber about a first axis, and the gear has a cylindrical outer wall defining a series of grooves. Each groove has an associated aperture extending through the gear member to an inner surface of the gear member. Each groove and associated aperture is radially positioned between adjacent teeth of the internally toothed gear member. An externally toothed gear member is rotatably supported within the internally toothed gear about a second axis spaced apart from the first axis. A drive shaft is coupled for rotation with the externally toothed gear member. The internally toothed gear member and externally toothed gear member cooperate to form a plurality of variable volume pumping chambers therebetween to pump fluid from the fluid inlet to the fluid outlet.

In another embodiment, a gerotor fluid pump for a vehicle component is provided with a housing defining a cylindrical chamber with a fluid inlet and a fluid outlet spaced apart therefrom. An idler rotor is positioned within the chamber and has a cylindrical outer wall adjacent to the cylindrical chamber and defining a series of grooves therein. An inner wall of the idler rotor defines a first series of teeth. Each groove corresponds with an associated tooth of the first series of teeth and has an opening fluidly connecting the groove and the inner wall. An inner rotor is driven by a pump shaft and is positioned within the idler rotor. The inner rotor has an outer wall defining a second series of teeth. The teeth of the inner rotor and the idler rotor cooperate to form a variable volume chamber to provide fluid flow through the pump as the inner rotor drives the idler rotor. An axis of rotation of the inner rotor is offset from an axis of rotation of the idler rotor. The opening and the groove of the idler rotor provide a fluid pathway for pressure relief in the pump thereby reducing tonal noise.

In yet another embodiment, an idler rotor for a gerotor pump is provided with a body having a cylindrical outer wall defining a series of longitudinal grooves. The body has an inner wall surrounding a central region and defining a series of teeth. Each tooth is radially aligned with a respective groove. The body defines a series of apertures. Each aperture is associated with a respective groove and extends radially through the body to fluidly connect the central region with the groove.

DETAILED DESCRIPTION

Figure 1:
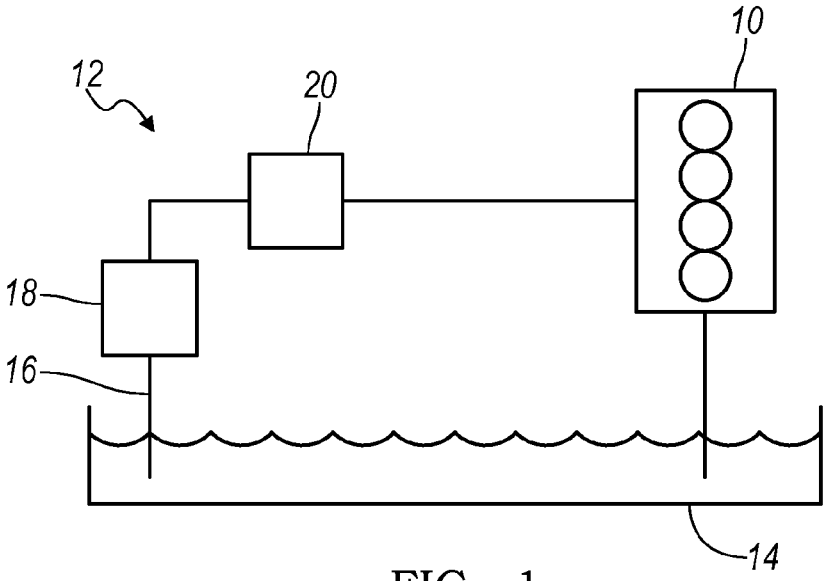
FIG. 1 illustrates a schematic of a lubrication system for an internal combustion engine in a vehicle according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A vehicle component 10, such as an internal combustion engine or transmission in a vehicle, includes a lubrication system 12. The vehicle component 10 is described herein as an engine, although use with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer and is in fluid contact with oil in the sump 14.

The pump 18 receives oil from the intake 16 and pressurizes and drives the oil such that it circulates through the system 12. The pump 18 is described in greater detail below with reference to FIGS. 2-4. In one example, the pump 18 is driven by a rotating component of the engine 10, such as a belt or mechanical gear train driven by the camshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, and the like.

In other examples, the pump 18 may be implemented on other vehicle systems, for example, as a fuel pump, and the like.

FIGS. 2-5 illustrate a pump 50 and various components thereof. The pump 50 may be used in the lubrication system 12 as pump 18. The pump 50 has a housing 52 and a cover 54. The housing 52 and the cover 54 cooperate to form an internal chamber 56. The cover 54 connects to the housing 52 to enclose the chamber 56. The cover 54 may attach to the housing 52 using one or more fasteners, such as bolts, or the like. A seal, such as an O-ring or a gasket, may be provided to seal the chamber 56.

Figure 3:
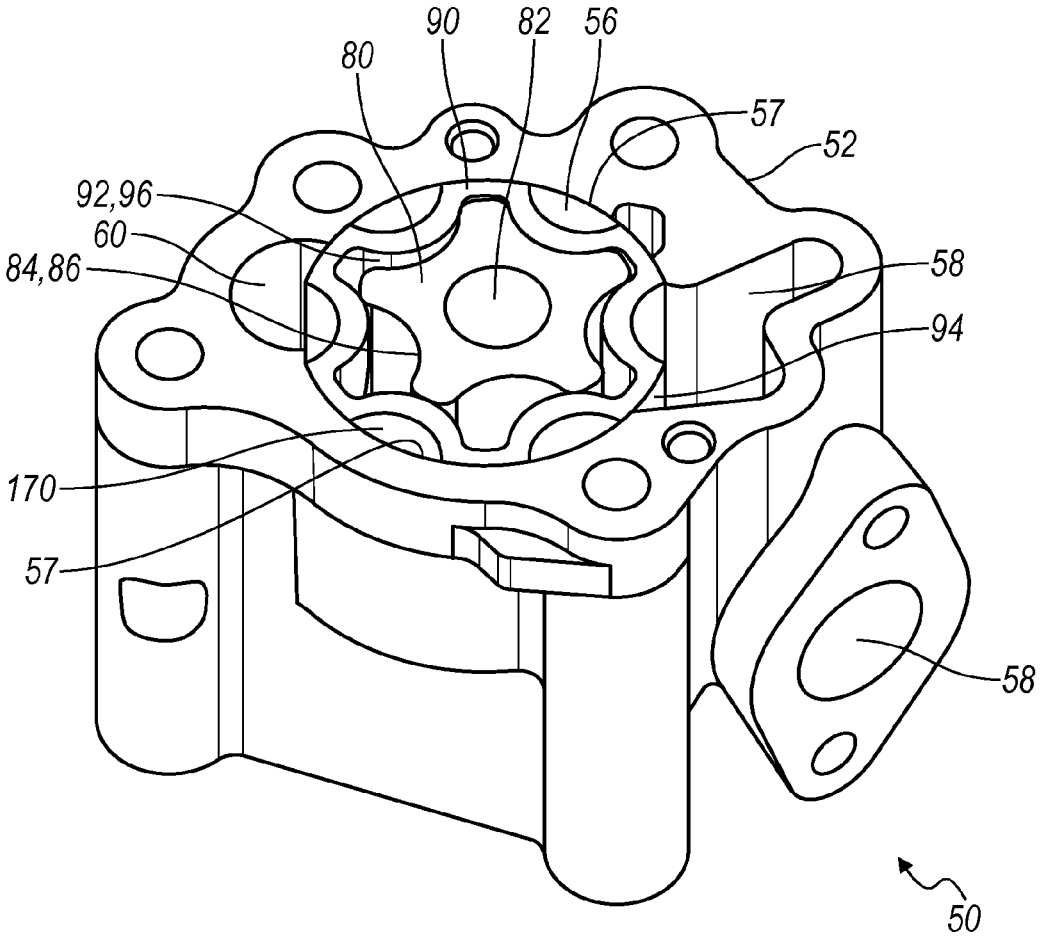
FIG. 3 illustrates a partial perspective view of a portion of the gerotor pump of FIG. 2.

The internal chamber 56 may be provided with or defined by a substantially cylindrical support or guide wall 57 as shown in FIG. 3. The guide wall 57 may include one or more sections of wall that have a common radius of curvature and center. Various sections of the guide wall 57 may lie about a perimeter of a common cylinder.

Figure 2:
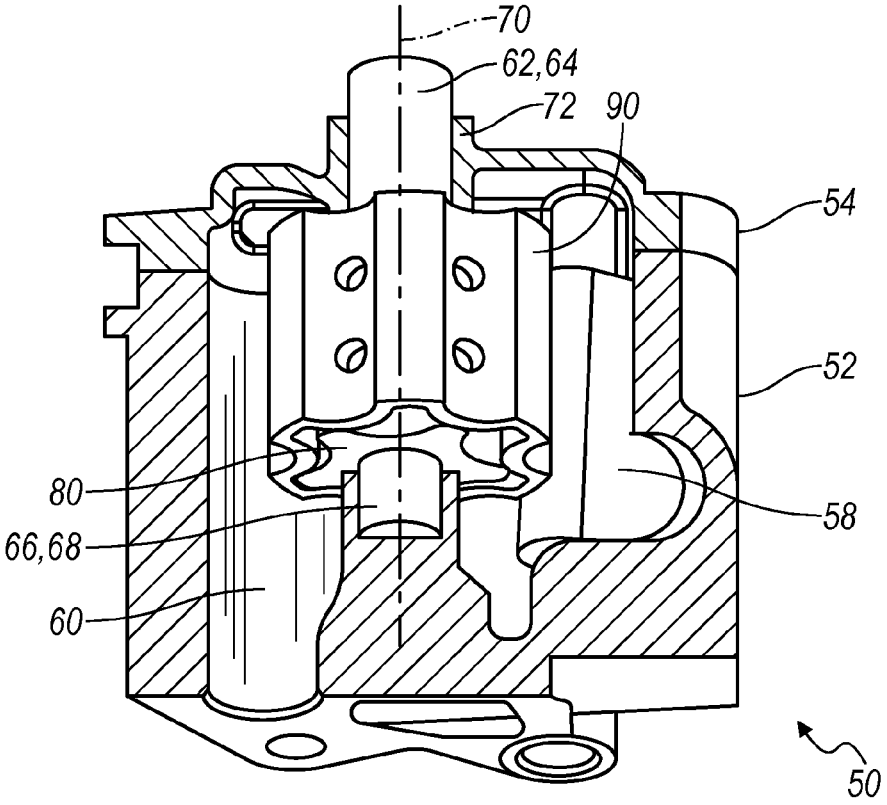
FIG. 2 illustrates a perspective sectional view of gerotor pump according to an embodiment.

The pump 50 has a fluid inlet 58 and a fluid outlet 60. The fluid inlet 58 has an inlet port as shown in FIG. 3 that is adapted to connect to a conduit such as intake 16 in fluid communication with a supply, such as an oil sump 14. The fluid inlet 58 is fluidly connected with the chamber 56 and intersects the wall(s) 57 such that fluid within the inlet 58 flows into the chamber 56. As shown in FIG. 2, both the housing 52 and the cover 54 may define portions of the inlet 58 region. The inlet 58 may be shaped to control various fluid flow characteristics.

The fluid outlet 60 has an outlet port as shown in FIG. 2 that is adapted to connect to a conduit in fluid communication with an oil filter, a vehicle component such as an engine, etc. The fluid outlet 60 is fluidly connected with the chamber 56 and intersects the wall(s) 57 such that fluid within the chamber 56 flows into the outlet 60. As shown in FIG. 2, both the housing 52 and the cover 54 may define portions of the outlet 60 region. The outlet 60 may be shaped to control various fluid flow characteristics. The inlet 58 and the outlet 60 are spaced apart from one another by a section of wall 57, and in one example, may be generally opposed to one another.

The pump 50 has a pump shaft 62 or driveshaft. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end 64 of the pump shaft 62 is splined or otherwise formed to mechanically connect with a rotating vehicle component to drive the pump 50.

The other end 66 of the shaft 62 is supported for rotation within the housing 52 of the pump 50. The housing may define a support 68 for the end 66 of the shaft to rotate therein. The support 68 may include a bushing, a bearing connection, or the like. The shaft 62 rotates about a longitudinal axis 70 of the shaft 62.

The shaft 62 extends through the cover 54, and the cover 54 defines an opening 72 for the shaft 62 to pass through. The opening 72 may include a sleeve or a seal to retain fluid within the pump and prevent or reduce leakage from the chamber 56. The opening 72 may also include additional bushings or bearing assemblies supporting the shaft 62 for rotation therein.

An inner rotor 80 or inner gear is connected to the pump shaft 62 for rotation therewith. The inner rotor 80 has an inner surface or wall 82 and an outer surface or wall 84. The inner wall 82 is formed to couple to the pump shaft 62 for rotation therewith about the axis 70. In one example, the inner wall is splined to mate with a corresponding splined section of the pump shaft 62. The outer wall 84 defines a series of external gear teeth 86. The inner rotor 80 may be defined as an externally toothed gear.

An outer rotor 90, outer gear, or idler gear or rotor surrounds the inner rotor 80 and is supported for rotation within the chamber 56. The outer rotor 90 has an inner surface or wall 92 and an outer surface or wall 94. The inner wall 92 defines a series of internal gear teeth 96. The outer rotor 90 may be defined as an internally toothed gear. The outer wall 94 is cylindrical in shape and is sized to be received by and generally interface with the cylindrical wall sections of the housing for rotation therein about an axis 98. Axis 98 is the longitudinal or central axis of the cylindrical chamber 56 in the housing. The outer wall 94 may be directly adjacent to and may contact the cylindrical wall sections 57, as the wall sections 57 act to retain the outer rotor 90 in position during pump 50 operation.

Figure 4:
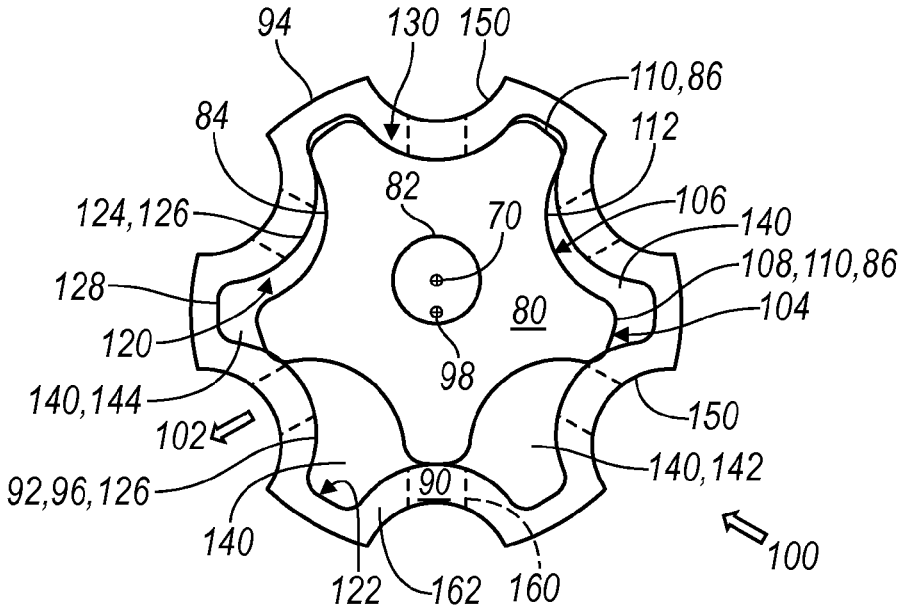
FIG. 4 illustrates a top view of the inner and outer rotors of the gerotor pump of FIG. 2.
Figure 5:
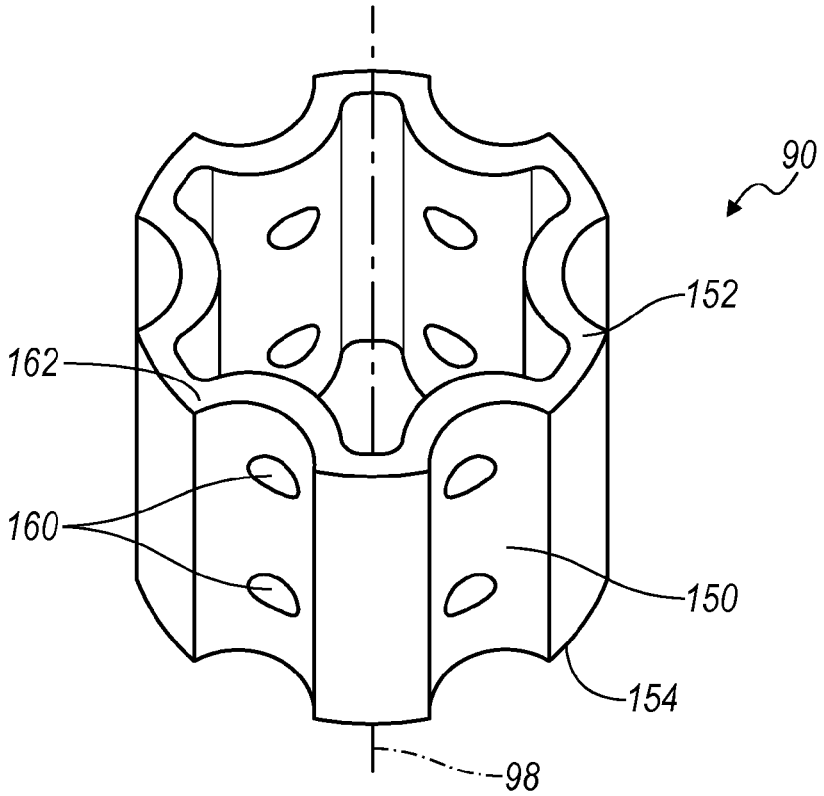
FIG. 5 illustrates a perspective view of the outer rotor of the gerotor pump of FIG. 2.

FIG. 4 illustrates a top view of the inner rotor 80 and outer rotor 90. Flow into the pump 50 is generally indicated by arrow 100. Flow out of the rotor 80 pump is generally illustrated by arrow 102.

The inner rotor 80 is rotated about axis 70 by the pump shaft 62. The series of teeth 86 on the inner rotor 80 have an addendum region 104 and a dedendum region 106. The addendum region 104 is adjacent to the top land 108 of each tooth 110. The dedendum region 106 is adjacent to the bottom land 112 between adjacent teeth 110. Each of the addendum and dedendum regions 104, 106 may be formed by a cycloid shape, or another shape. In the example shown, the dedendum region 106 is formed by a cycloid or a hypocycloid shape such that the dedendum regions 106 are smooth curves.

The outer rotor 90 has a series of inner gear teeth 96 that have an addendum region 120 and a dedendum region 122. The addendum region 120 is adjacent to the top land 124 of each tooth 126 and the dedendum region 122 is adjacent to the bottom land 128 between adjacent teeth 126. Each of the addendum and dedendum regions 120, 122 may be formed by a cycloid shape, or another shape. In the example shown, the addendum region 120 is formed by a cycloid or a hypocycloid shape such that the addendum regions 120 are smooth curves. The addendum region 120 is formed with the same curve or shape as the dedendum region 106 of the inner rotor 80 such that the regions 106, 120 mate to form a continuous seal as illustrated by arrow 130.

As the inner rotor 80 is rotated by the shaft 62, the teeth 86 of the inner rotor 80 mesh with the teeth 96 of the outer rotor 90, and the outer rotor 90 is driven as an idler by the inner rotor 80. In the present example, the pump shaft 62 rotates the inner rotor 80 in a clockwise direction, and the idler rotor 90 is rotated in a clockwise direction by the inner rotor 80. As the inner rotor 80 rotates about an axis 70 that is offset relative to the axis of rotation 98 of the outer rotor 90, the inner rotor 80 is eccentric relative to the outer rotor 90 and the cylindrical housing 56, 57. As can be seen from FIGS. 3 and 4, the pump 50 operates without a crescent shaped seal or insert in the chamber 56.

A plurality of chambers 140 are formed between the inner rotor 80 and the outer rotor 90. Each chamber 140 has a variable volume as the pump 50 operates. Each chamber 140 increases in volume to draw in the fluid from the inlet 58, and then decreases in volume to push the fluid out of the outlet 60. A chamber that is increasing in volume is shown at 142. A chamber that is decreasing in volume is shown at 144.

The cylindrical outer wall 94 defines a series of grooves 150 or depressions therein. Note that a conventional outer rotor typically has a smooth, continuous, cylindrical outer wall without depressions 150. In one example, the series of grooves 150 are spaced equally about the perimeter of the outer wall 94. In other examples, the grooves 150 may be spaced alternately or in another order, for example, as groups of three grooves with a spaced apart region, and may be positioned to reduce pump associated noise at the dominant pump orders.

Each groove in the series of grooves 150 may extend from a first end 152 of the outer gear to a second end 154 of the outer gear. Each groove in the series of grooves 150 may be generally parallel with the axis 98, for example, within two degrees, five degrees, or ten degrees of the axis 98. Each groove in the series of grooves 150 may be uniform along the length of the groove as shown. In alternative examples, the grooves 150 may have sections with increasing and/or decreasing tapered shapes along their length. The grooves 150 are illustrated as having a cross section formed as an arc or section of a circle. In other examples, the grooves 150 may have other cross sectional shapes including triangular, parabolic, other smooth continuous curves and/or linear discontinuous shapes. Each groove 150 is shown as being symmetrical; however, asymmetric grooves are also contemplated. The cross sectional shape of the groove 150 may be constant or may change along the length of the groove. In the present example, each groove 150 has a radius of curvature such that it is formed by a smooth curve or an arc of a circle, and is positioned to be concentric with an associated top land 124 of the inner gear teeth 126.

The grooves 150 are positioned between adjacent bottom lands 128 or between adjacent dedendum regions 122 of the outer rotor 90. The grooves 150 may be radially aligned with a corresponding addendum region 120 or corresponding top land 124 of the outer rotor 90. For idler rotors with alternate groove spacing, some of the top lands 124 have an associated groove and aperture, and others are provided without a groove and aperture. For idler rotors with equal groove and aperture spacing, each top land 124 has an associated groove and aperture.

Each groove 150 defines an aperture 160 that extends through the wall 162 of the outer rotor to fluidly connect the groove 150 with the inner wall 92 of the outer rotor 90, and with a variable volume chamber 140. The grooves 150 may each have a single aperture 160, or may have two or more apertures 160. The apertures 160 may be provided with a circular, elliptical, slotted, or otherwise shaped cross section. The apertures 160 may be substantially circular, for example, with a radius that varies about the aperture by no more than 10 percent. The apertures 160 in each groove 150 may be the same size as shown, or may be different sizes. The apertures 160 may have a constant cross sectional area through the wall 162 of the outer rotor 90, or may have an increasing or decreasing cross sectional area. The apertures 160 may be equally spaced with respect to one another and the outer rotor 90, or may be offset relative to one another and/or the outer rotor 90.

As the pump 50 operates, pressure ripples of the fluid in the pump 50 may act as a source of excitation to powertrain components, for example, when the pump 50 is mounted to the powertrain components. For example, the pump 50 may be mounted to an engine block, a transmission housing, an oil pan or sump housing, a transmission bell housing, and the like, where the pressure ripples may cause tonal noise or whine from the engine or the transmission. The outer rotor 90 design of the present disclosure acts to reduce or eliminate the oil pump-induced powertrain whine or tonal noise by providing pressure relief or acting in a bypass capacity.

Figure 6:
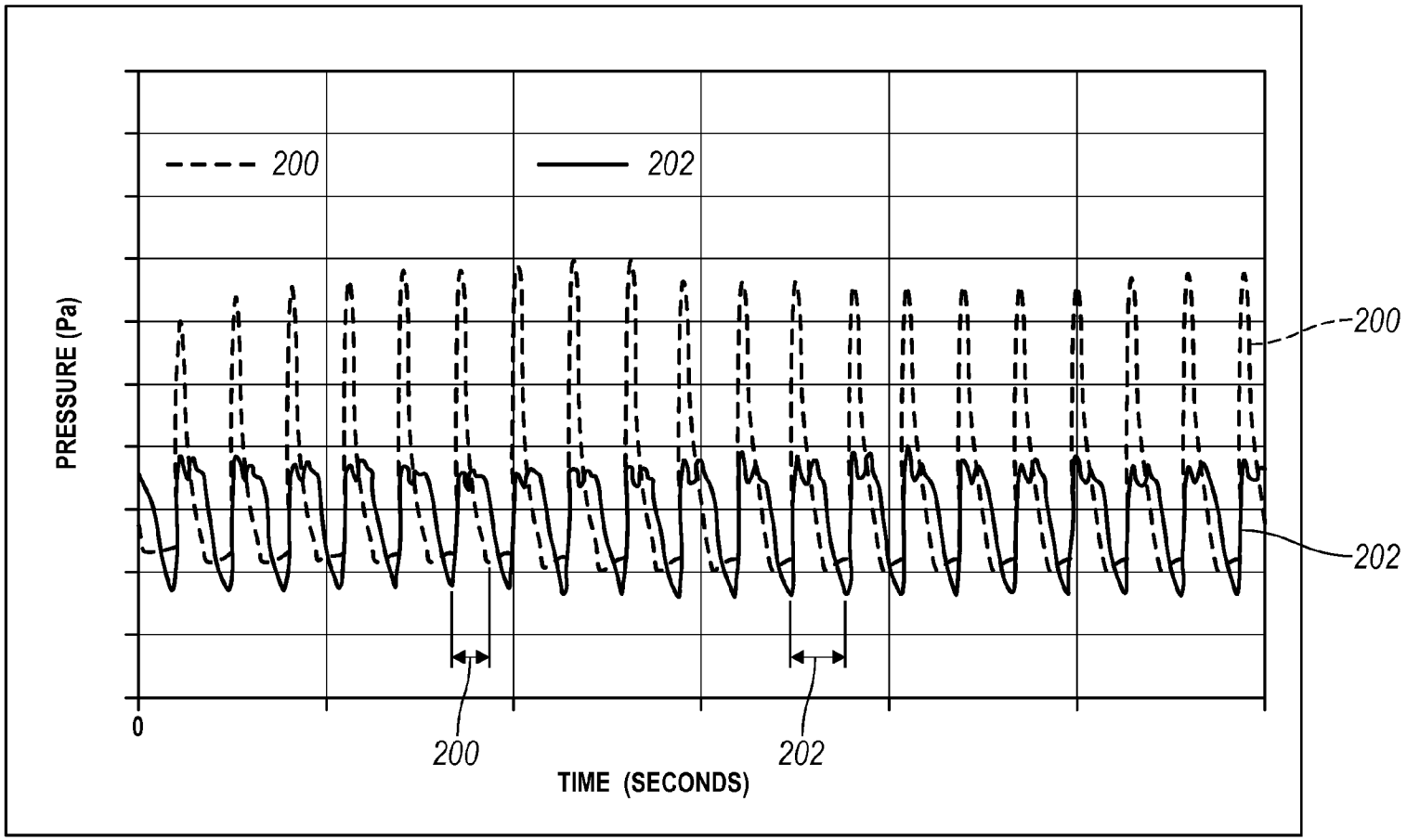
FIG. 6 illustrates a graph of pressure output from the pump of FIG. 2 compared to a pressure output from a pump with a conventional idler rotor.
Figure 7:
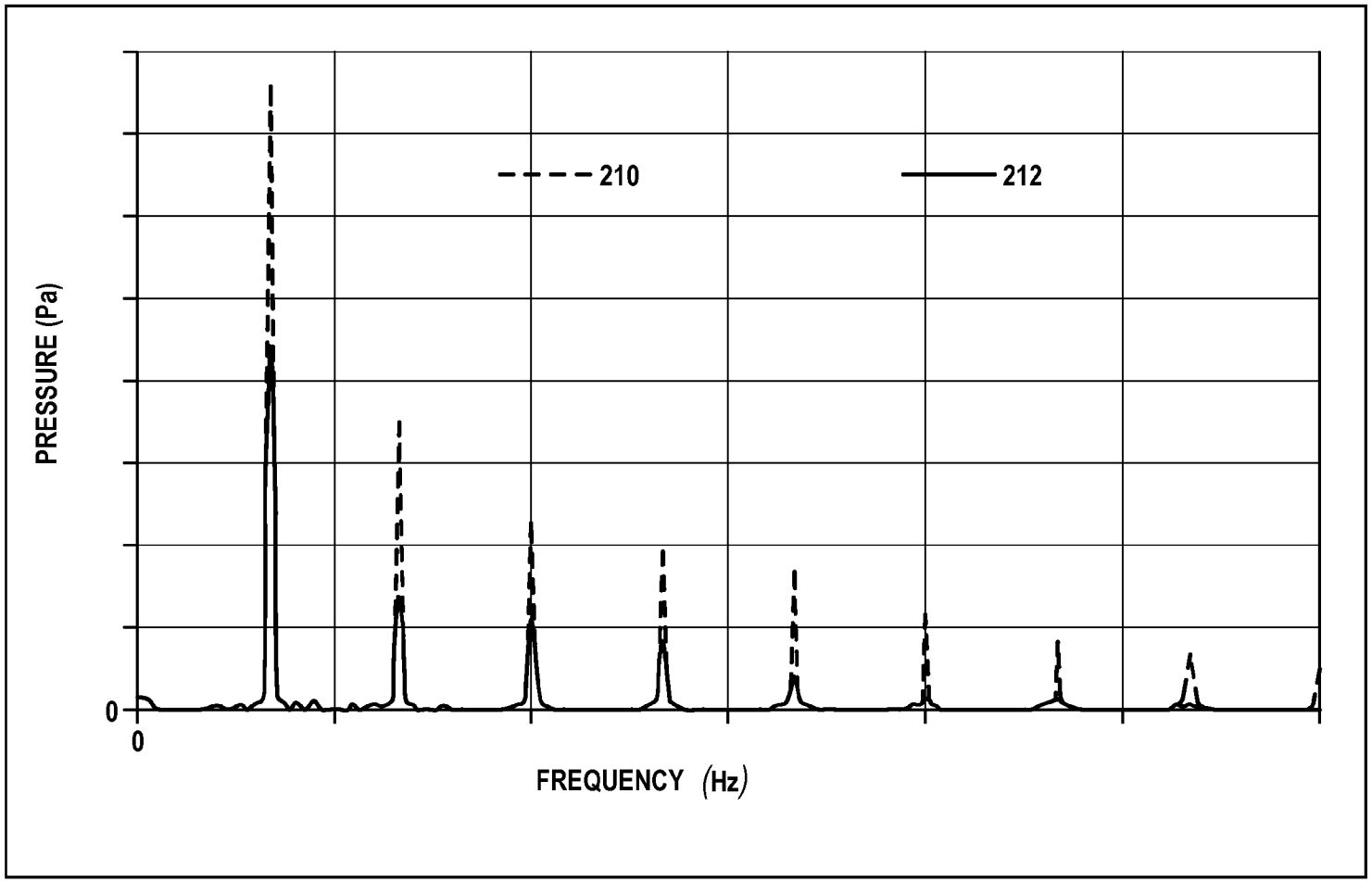
FIG. 7 illustrates a frequency domain analysis for the pump of FIG. 2.

The grooves 150 and the apertures 160 provide pressure relief for the pump 50 and act to reduce the tonal noise or whine. As the pump 50 operates, fluid within one of the variable volume chambers 140 is able to flow from the chamber 140 through an aperture 160, across the outer rotor 90 and into a groove 150. The grooves 150 each form an outer chamber 170 with the cylindrical wall 57 of the housing 52. Modeling and testing of the outer rotor 90 with the grooves 150 and apertures 160 show improved pump operating characteristics compared to a conventional outer rotor. A gerotor pump having the rotor as described herein showed a reduction in pressure ripples or spikes during operation. For example, as shown in FIG. 6, a conventional pump while operating may provide fluid at the outlet of the pump with pressure fluctuations or pressure waves as shown by line 200 during a steady state operating condition. These pressure fluctuations are a difference between a maximum fluid pressure or spike and a minimum fluid pressure at the outlet. The pump 50 according to the present disclosure has a pressure fluctuation as shown by line 202 for the same steady state operating condition. In addition to a significant decrease in pressure fluctuation, the pump 50 according to the present disclosure also provides the fluid at the high pressure value for a longer time period, whereas the high pressure from the conventional pump appears as a spiked value and is not sustained. Additionally, an analysis across a frequency domain showed a significant decrease in pressure peaks for the various orders of the pump 50, with the pressure peaks essentially disappearing for the higher orders as shown in FIG. 7 with a conventional pump illustrated by line 210, and a pump 50 according to the present disclosure illustrated by line 212.

The pump 50 according to the present disclosure provides for a comparable or increased fluid pressure at the pump outlet compared to the conventional pump across a range of pump speeds. Therefore, the pump 50 according to the present disclosure does not incur any significant losses based on differences in efficiencies, etc., and is in fact may be said to be more efficient depending on the pump speed.

The pump 50 according to the present disclosure additionally provides for decreased noise. For example, when the pump 50 according to the present disclosure is used with a powertrain for a vehicle the tonal noise from the powertrain is reduced. In one example, the pump according to the present disclosure is used with a four cylinder engine for a vehicle and resulted in noise reductions ranging between 2-10 decibels for the various pump orders and across a frequency range compared to a conventional gerotor pump. The tonal noise reduction using the pump 50 may provide for reduced noise, vibration, and harshness (NVH) from the powertrain. Additionally, the powertrain or lubrication system may be simplified using a pump 50 according to the present disclosure. For example, the powertrain or lubrication system with a conventional pump may include noise reduction devices or features, and these features may be eliminated by switching to a pump according to the present disclosure. In one example, the conventional lubrication system includes a damping material such as a mastic located on the oil sump, and this damping material may be removed by switching to a pump 50 as described herein without an increase in tonal noise from the powertrain.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A gerotor pump comprising:

a body defining a chamber with cylindrical wall sections and having a fluid inlet and a fluid outlet;

a cover configured to mate with the body to enclose the chamber;

an internally toothed gear member supported for rotation within the chamber about a first axis, the member having a cylindrical outer wall defining a series of grooves, the member defining a first end and a spaced apart second end, each groove extending from the first end to the second end, each groove being parallel with the first axis, each groove having an associated aperture extending through the gear member to an inner surface, each groove and associated aperture radially aligned with an addendum region of a corresponding internal tooth of the internally toothed gear member;

an externally toothed gear member rotatably supported within the internally toothed gear member about a second axis spaced apart from the first axis; and a drive shaft coupled for rotation with the externally toothed gear member;

wherein the internally toothed gear member and externally toothed gear member cooperate to form a plurality of variable volume pumping chambers therebetween to pump fluid from the fluid inlet to the fluid outlet.

2. The pump of claim 1 wherein each groove defines another associated aperture extending through the internally toothed gear member to an inner surface.

3. The pump of claim 2 wherein the aperture and the another aperture of each groove each have a circular cross section.

4. The pump of claim 2 wherein the aperture and the another aperture of each groove are spaced apart from one another longitudinally in the groove.

5. The pump of claim 1 wherein the internally toothed gear member has (n) teeth, and the externally toothed gear member has (n−1) teeth.

6. The pump of claim 1 wherein an addendum region of the internally toothed gear member is configured to form a continuous fluid tight seal with a dedendum region of the externally toothed gear member.

7. The pump of claim 1 wherein the fluid inlet is generally opposed to the fluid outlet in the chamber.

8. The pump of claim 1 wherein each groove and associated aperture are radially aligned with a top land of a corresponding internal tooth of the internally toothed gear member.

9. A gerotor fluid pump for a vehicle component comprising:

a housing defining a cylindrical chamber with a fluid inlet and a fluid outlet spaced apart therefrom;

an idler rotor positioned within the chamber and having a cylindrical outer wall adjacent to the cylindrical chamber and defining a series of grooves therein, and an inner wall defining a first series of teeth, each groove intersecting first and second opposed ends of the idler rotor, each groove radially aligned with a top land of an associated tooth of the first series of teeth and having an opening fluidly connecting the groove and the inner wall; and an inner rotor driven by a pump shaft and positioned within the idler rotor and having an outer wall defining a second series of teeth;

wherein the teeth of the inner rotor and the idler rotor cooperate to form a variable volume chamber to provide fluid flow through the pump as the inner rotor drives the idler rotor;

wherein an axis of rotation of the inner rotor is offset from an axis of rotation of the idler rotor;

wherein each groove is parallel with the axis of rotation of the inner rotor; and wherein the opening and the groove of the idler rotor provide a fluid pathway for pressure relief in the pump thereby reducing tonal noise.

10. The pump of claim 9 wherein the cylindrical outer wall of the idler rotor is constrained by wall sections of the cylindrical chamber of the housing; and wherein the series of the grooves of the idler rotor form fluid chambers with the wall sections of the cylindrical chamber.

11. The pump of claim 9 wherein each groove is formed by a curved wall section that is a parallel curve with an addendum region of the associated tooth.

12. The pump of claim 9 wherein the first series of teeth comprises N teeth, the series of grooves comprises N grooves, and the second series of teeth comprises (N−1) teeth.

13. A gerotor pump idler rotor comprising:

a body having a cylindrical outer wall defining a series of longitudinal grooves and an inner wall surrounding a central region and defining a series of teeth extending inwardly therefrom, each groove intersecting opposed ends of the body and radially aligned lengthwise with one of the series of teeth, each groove having an associated aperture extending radially through the body to fluidly connect the central region with the groove.

14. The gerotor pump idler rotor of claim 13 wherein each groove has another aperture associated therewith and spaced apart longitudinally from the aperture in the groove, the another aperture extending radially through the body to fluidly connect the central region with the groove.

* * * * *